United States Patent [19]

Armeno et al.

[11] Patent Number: 4,605,579

[45] Date of Patent: Aug. 12, 1986

[54] DECORATIVE HEAT RETAINING PIZZA COVER

[76] Inventors: Michael Armeno, 508 E. Lincoln Ave., Cranford, N.J. 07016; Ralph L. Parla, 4080 E. Ridgewood Ave., Las Vegas, Nev. 89120

[21] Appl. No.: 766,524

[22] Filed: Aug. 19, 1985

[51] Int. Cl.[4] ..... B65D 51/00

[52] U.S. Cl. ..... 428/66; 206/545; 428/7; 428/187

[58] Field of Search ..... 428/7, 64, 66, 187; 206/545, 549; 220/412

[56] References Cited

U.S. PATENT DOCUMENTS

| | | | |
|---|---|---|---|
| 561,507 | 6/1896 | Fenton | 428/66 X |
| 2,354,857 | 8/1944 | Gits et al. | 428/187 X |
| 3,397,074 | 8/1968 | Burachinsky et al. | 427/256 |
| 3,610,510 | 10/1971 | Lowry | 428/7 X |
| 3,649,391 | 3/1972 | Lewis | 428/187 X |
| 3,736,214 | 5/1973 | McBirnie | 428/7 |
| 4,058,214 | 11/1977 | Mancuso | 206/545 |
| 4,096,994 | 6/1978 | Bryson | 239/57 |
| 4,170,302 | 10/1979 | Baca | 428/64 X |
| 4,286,000 | 8/1981 | Dye et al. | 428/64 |
| 4,344,534 | 8/1982 | Sutton | 206/545 |
| 4,360,118 | 11/1982 | Stern | 206/545 X |
| 4,474,303 | 10/1984 | Maccise | 206/545 X |

*Primary Examiner*—Henry F. Epstein
*Attorney, Agent, or Firm*—Anthony F. Cuoco

[57] ABSTRACT

A decorative heat retaining pizza cover is disclosed which includes a member supported above the soft inner portion of the pizza by a plurality of standoffs, and tending to retain heat imparted to the pizza when the pizza is baked. The member may carry decorative legend and/or ornaments on its viewable surface indicative of a festive occasion, and the cover may be retained as a remembrance of said occasion.

6 Claims, 4 Drawing Figures

DECORATIVE HEAT RETAINING PIZZA COVER

BACKGROUND OF THE INVENTION

Pizza is a well known and highly popular food item. It is essentially an open pie made typically of thinly rolled bread dough spread with a spiced mixture of tomato sauce, cheese, meats, mushrooms and other like foods. It is baked so as to have a relatively soft inner portion surrounded by a relatively hard outer crust.

The popularity of pizza has extended its use to festive occasions such as birthdays, anniversaries, holidays and other like occasions, much as like the traditional cake heretofore commonly used for such occasions. To this extent, pizza parties and the like are now common occurrences.

Several problems exist with the use of pizza for the aforenoted purposes. First, pizza is best consumed hot, or at least warm, as it is immediately after baking. There has heretofore been no practical way of maintaining the heat or warmth within the pizza until it is ready for consumption. Second, unlike the traditional cake, the nature of pizza does not render it adaptable for carrying congratulatory or decorative messages, and/or ornaments, or the like, as the traditional cake. The present invention overcomes the aforenoted disadvantages by providing a cover which at the same time tends to maintain the heat or warmth within the pizza and carries the aforenoted messages, and/or ornaments, the same being highly desirable in view of the aforenoted extended use of pizza.

SUMMARY OF THE INVENTION

This invention contemplates a decorative heat retaining pizza cover including a member substantially the shape of the pizza and of a size to substantially cover the soft inner portion thereof, but not extending to the outer crust. A plurality of standoffs extend substantially normal to and downward from the outer edge of the member.

The member is supported above the pizza when the standoffs engage the outermost perimeter of the inner portion thereof. The member and standoffs are formed as an integral cover of a suitable plastic material having a relatively low heat transfer characteristic, such as polystyrene. The standoffs are contoured so as to firmly support the member above the pizza without disturbing the soft inner portion thereof. The upper surface of the member carries congratulatory or decorative messages, and/or ornaments, as the case may be.

DETAILED DESCRIPTION OF THE INVENTION

Figure 1:
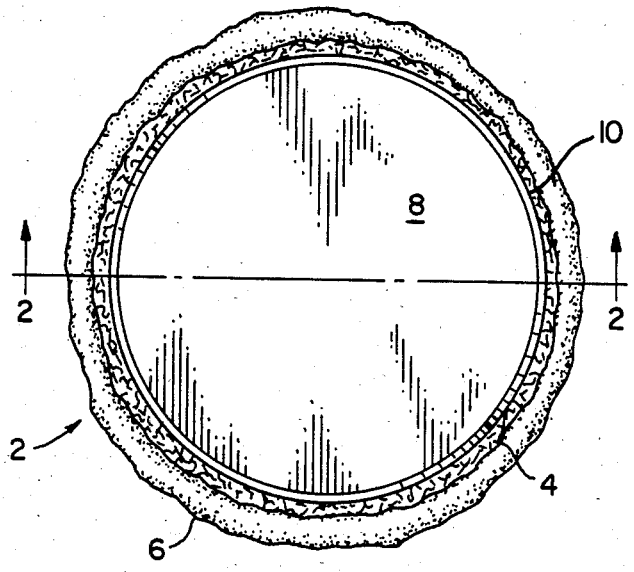
FIG. 1 is a diagrammatic top plan view showing a pizza and a cover supported thereover in accordance with the invention.
Figure 2:
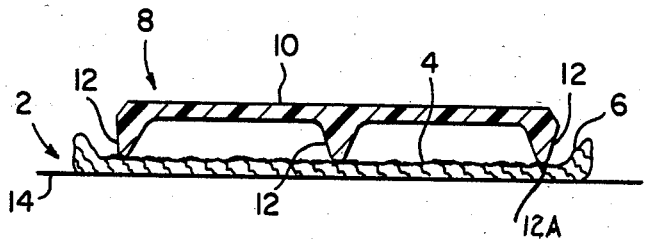
FIG. 2 is a diagrammatic sectional view taken along line 2—2 in FIG. 1.

With reference to FIGS. 1 and 2, a pizza is designated by the numeral 2. As is commonly known, Pizza 2 is substantially round or pie-shaped and is baked so as to have a relatively soft inner portion 4 surrounded by a relatively hard crust 6.

As is also commonly known, pizza 2 is consumed by cutting the pizza into generally triangular portions and is best consumed while hot or at least warm, immediately after baking. In order to maintain the heat within the pizza during the time that it is being consumed a cover 8 is supported over pizza 2. As best shown in FIGS. 1 and 2, cover 8 has a top member 10 which has the shape of the pizza and is sized so as to cover substantially all of soft inner portion 4. Cover 8 has a plurality of standoffs 12. In the preferred embodiment of the invention there are four such standoffs 12 disposed equidistantly around the outer edge of top member 10. Standoffs 12 engage soft inner portion 4 of pizza 2 just before crust 6 as best shown in FIG. 2. Standoffs 12 extend downward from and substantially normal to the outer edge of member 10.

Standoffs 12 are generally triangular in shape as shown in FIG. 2, and have an apex 12A which is contoured so as to engage soft inner portion 4 of pizza 2 without unduly disturbing the soft inner portion, but yet supporting cover 8 so that the cover is substantially stationary relative to the pizza.

As aforenoted, cover 8 retains heat within pizza 2, and to this end cover 8 is a unitary member of a suitable plastic material having relatively low heat transfer characteristics. Thus, in the preferred embodiment of the invention cover 8 is molded of, for example, an expanded rigid polystyrene plastic such as Styrofoam, which is a trademark of the Dow Chemical Corporation.

With further reference to FIG. 2, pizza 2 may be disposed on a dish or tray 14. Cover 8 is disposed over the pizza as aforenoted. In order to provide the desired heat retaining characteristics, it has been found that top member 8 is best about one-quarter of an inch thick. Standoffs 12 are best about one inch wide at their base and about three-quarters of an inch high. These dimensions may vary to some extent, depending on the size of the pizza and the depth of inner portion 4 thereof, as will now be understood.

Figure 3:
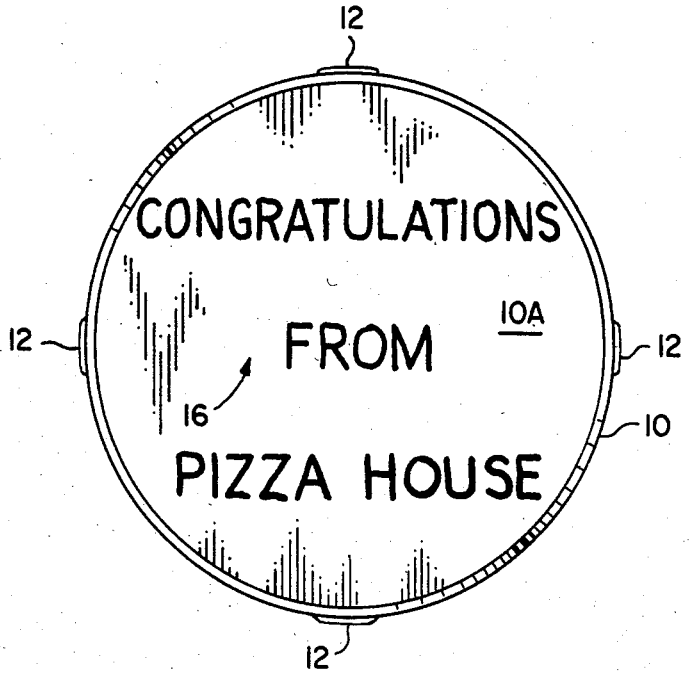
FIG. 3 is a diagrammatic top plan view of the pizza cover of the invention showing the message carrying feature thereof.
Figure 4:
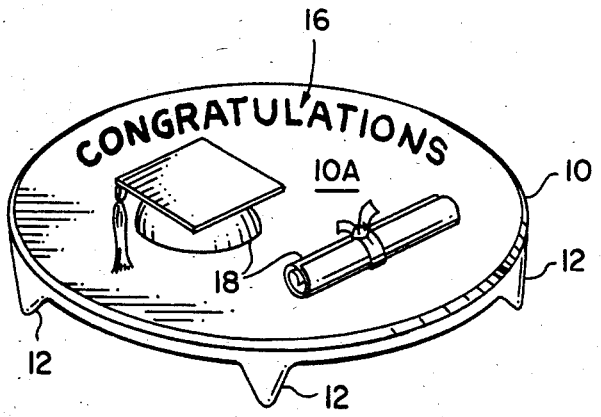
FIG. 4 is a pictorial representation best showing the message and ornament carrying features of the pizza cover of the invention.

A feature of the invention is that cover 8 may be decorative in nature and to this extent reference is made to FIGS. 3 and 4.

With reference first to FIG. 3, top member 10 of cover 8 may carry on its upper and viewable surface 10A a congratulatory message such as 16 or any other such message that may fit a specefic occasion. Message 16 may be applied via pressure sensitive means or any other such suitable means. With reference next to FIG. 4, in addition to the aforenoted message 16, top member 10 may carry on its surface 10A ornaments or momentos such as 18 that may likewise fit a specific occasion. In this regard ornaments 18 may also be applied via pressure sensitive means or any other such suitable means. Accordingly, as has heretofore not been possible, pizza 2 may be used in a fashion similar to that of the traditional cake in celebrating festive occasions and the like, as will now be understood.

It will be further understood that the invention as heretofore described may provide a souvenir or remembrance of the occasion being celebrated, and hence its utility is further enhanced.

With the aforegoing description of the invention in mind, reference is had to the claims appended hereto for a definition of the scope of the invention.

What is claimed is:

1. A cover for a pizza of the type which is baked so as to have a relatively soft inner portion and a relatively hard crust surrounding the soft inner portion, characterized by:

a top member substantially the size and shape of the soft inner portion;

a plurality of standoffs integral with the top member and engaging the soft inner portion just before the hard crust so as to support the top member above the soft inner portion; and the cover being of a material having a relatively low heat transfer characteristic, whereby the cover tends to retain heat within the pizza which has been imparted to the pizza when said pizza is baked.

2. A cover for a pizza as described by claim 1, further characterized by:

the plurality of standoffs including four standoffs equally spaced around the perimeter of the top member and extending substantially normal to and downward from the outer edge of said member.

3. A cover for a pizza as described by claim 1, further characterized by:

each of the plurality of standoffs being substantially triangular in shape and having a contoured apex for engaging the inner portion of the pizza so as not to disturb said inner portion and for supporting the cover substantially stationary relative to the pizza.

4. A cover for a pizza as described by claim 1, further characterized by:

the top member having a viewable surface; and the viewable surface carrying decorative legend.

5. A cover for a pizza as described by claim 1, further characterized by:

the top member having a viewable surface, and the viewable surface carrying decorative ornamentation.

6. A cover for a pizza of the type which is baked so as to have a relatively soft inner portion and a relatively hard crust surrounding the soft inner portion, characterized by:

a top member substantially the size and shape of the soft inner portion;

a plurality of standoffs integral with the top member and extending substantially normal to and downward from the outer edge of said member, and engaging the soft inner portion just before the hard crust so as to support the top member above the soft inner portion;

each of the plurality of standoffs being substantially triangular in shape and having a contoured apex for engaging the soft inner portion so as not to disturb said inner portion and for supporting the cover substantially stationary relative to the pizza;

the top member having a viewable surface, with said surface carrying decorative means; and the cover being of a material having a relatively low heat transfer characteristic, whereby the cover tends to retain heat within the pizza imparted thereto when the pizza has been baked.

* * * * *